US006872892B1

(12) United States Patent
Burdick

(10) Patent No.: US 6,872,892 B1
(45) Date of Patent: Mar. 29, 2005

(54) ELECTRIC FENCE INSULATORS

(75) Inventor: Brett R. Burdick, Knoxville, TN (US)

(73) Assignee: Fi-Shock, Inc., Knoxville, TN (US)

( * ) Notice: Subject to any disclaimer, the term of this patent is extended or adjusted under 35 U.S.C. 154(b) by 0 days.

(21) Appl. No.: 10/688,114

(22) Filed: Oct. 17, 2003

(51) Int. Cl.[7] ..... E04H 17/10; H01B 17/00

(52) U.S. Cl. ..... 174/158 F; 174/45 R; 174/161 F; 174/163 F; 256/DIG. 3; 256/10

(58) Field of Search ..... 174/45 R, 158 R, 174/158 F, 161 F, 163 R, 163 F, 164, 166 R, 169, 172; 256/DIG. 3, 1, 3, 10, 32, 42, 47, 54–56

(56) References Cited

U.S. PATENT DOCUMENTS

| | | | | | |
|---|---|---|---|---|---|
| 1,136,471 | A | | 4/1915 | Leilich et al. | |
| 2,805,277 | A | | 9/1957 | Moeller et al. | |
| 3,652,780 | A | * | 3/1972 | Wilson | 174/163 F |
| 3,654,383 | A | | 4/1972 | Wilson | |
| 3,820,758 | A | | 6/1974 | Berg, Jr. et al. | |
| 4,028,489 | A | | 6/1977 | Berg, Jr. et al. | |
| 4,049,905 | A | * | 9/1977 | Maranell | 174/163 F |
| 4,299,048 | A | | 11/1981 | Bayes | |
| 4,692,567 | A | | 9/1987 | Crum | |
| 4,771,137 | A | | 9/1988 | Thompson | |
| 5,063,274 | A | * | 11/1991 | Johnson | 174/158 F |
| 5,085,409 | A | * | 2/1992 | Teixeira | 174/158 F |
| 5,850,808 | A | | 12/1998 | Burdick | |
| 5,959,255 | A | | 9/1999 | Langlie et al. | |
| 5,975,501 | A | * | 11/1999 | Berg et al. | 174/158 F |
| 6,283,064 | B1 | | 9/2001 | Djukastein et al. | |
| 6,489,569 | B1 | * | 12/2002 | Thomson | 174/158 F |

FOREIGN PATENT DOCUMENTS

| | | | |
|---|---|---|---|
| EP | 0860116 A1 | | 8/1998 |
| GB | 2132824 | | 7/1984 |
| GB | 2187771 A | * | 3/1986 |
| GB | 2295627 | | 6/1996 |
| SU | 1617465 A1 | | 12/1990 |

* cited by examiner

*Primary Examiner*—Anthony Dinkins
*Assistant Examiner*—Adolfo Nino
(74) *Attorney, Agent, or Firm*—Luedeka, Neely & Graham PC

(57) ABSTRACT

A molded plastic fence insulator including a pair of spaced apart sidewalls connected by a connecting wall, aligned grooves defined across the connecting wall, and retention members associated with the aligned grooves and configured for receiving the wires underneath a portion thereof.

25 Claims, 4 Drawing Sheets

ELECTRIC FENCE INSULATORS

FIELD OF THE INVENTION

This invention relates generally to insulators for electric features. More particularly, this invention relates to insulators mountable to a support structure for supporting and maintaining a pair of electric fence wires in a spaced apart relationship.

BACKGROUND AND SUMMARY OF THE INVENTION

Electric fences of the type utilizing a ground wire, a current carrying wire, and a source of electrical current are known. The ground wire and the current carrying wire are conventionally spaced apart and positioned generally parallel to one another using separate insulator devices. The spacing between the wires are such that an animal coming in contact with the fence will contact both wires. This creates a current path to complete the circuit such that the animal receives a mild electrical shock.

The wires are often suspended or supported from a support structure, such as a board, or a metal or wood post. It is important to electrically isolate or insulate the wires from the support structure and to prevent the ground wire and the current carrying wire from contacting one another. It is also important to maintain the wires in a desired spaced relationship so that an animal contacting the fence will be likely to simultaneously contact both wires so that a shock is received by the animal.

Separate insulators have been used to support the spaced apart wires due to the need to electrically isolate the wires from one another. The use of separate insulators, however, is cumbersome and desires improvement.

With regard to the foregoing, the present invention is directed to a fence insulator for maintaining a pair of fence wires in a desired common plane and spaced a desired distance apart.

In a preferred embodiment, the insulator includes a body of molded plastic construction mountable to a support and including a pair of spaced apart sidewalls connected by a connecting wall.

A first pair of aligned grooves are defined across the connecting wall and a first retention member is positioned adjacent the first pair of aligned grooves and configured for receiving one of the wires underneath a portion thereof.

A second pair of aligned grooves is also defined across the connecting wall and spaced apart from and substantially parallel to the first pair of aligned grooves. A second retention member is positioned adjacent the second pair of aligned grooves and configured for receiving one of the wires underneath a portion thereof.

One of the wires is positionable underneath the first retention member and within the first pair of aligned grooves and the other one of the wires is positionable underneath the second retention member and within the second pair of aligned grooves.

In one preferred embodiment, the retention members are pairs of oppositely disposed fingers located adjacent the connecting wall and spaced interior the pairs of grooves. In another embodiment, the retention members are flexible tabs defined adjacent the connecting wall with underlying cutouts defined within the connecting wall.

In another aspect, the fence insulator includes an elongate body of molded plastic construction mountable to a support and including a wire mounting face. A first retention member is positioned adjacent the wire mounting face and configured for receiving one of the wires underneath a portion thereof. A second retention member is configured for receiving the other one of the wires underneath a portion thereof and is located adjacent the wire mounting face and longitudinally spaced apart from the first retention member.

In still another aspect, the invention relates to a fence insulator for installation at corners of a fence or other locations where first and second spaced apart fence wires undergo an abrupt change of direction.

In a preferred embodiment, the insulator includes an elongate body of molded plastic construction mountable to a support and including a wire mounting face. A first rigid tab is positioned adjacent the wire mounting face and has an opening for passage of the first wire and a curved closed end configured for bearing against the first wire to provide a radius for the first wire to curve around to reduce stresses on the first wire as it undergoes a relatively abrupt change of direction. A second rigid tab is positioned adjacent the wire mounting face longitudinally spaced apart from the first tab. The second tab has an opening for passage of the second wire and a curved closed end configurated for bearing against the second wire to provide a radius for the second wire to curve around to reduce stresses on the second wire as it undergoes a relatively abrupt change of direction.

In yet another aspect, the invention relates to a fence system which preferably includes a current carrying wire connectable to a source of electric current, a ground wire, and a unitary insulator configured to receive the current carrying wire and the ground wire and to maintain the wires in a spaced apart and electrically isolated orientation.

BRIEF DESCRIPTION OF THE DRAWINGS

Further features of preferred embodiments of the invention will become apparent by reference to the detailed description of preferred embodiments when considered in conjunction with the figures, which are not to scale, wherein like reference numbers, indicate like elements through the several views, and wherein.

DETAILED DESCRIPTION

FIGS. 1A–1D

Figure 1D:
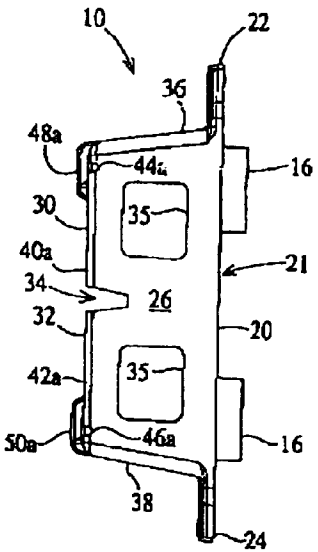
FIGS. 1B–1D are front, top, and left side plan views, respectively, of the insulator of FIG. 1A.
Figure 1B:
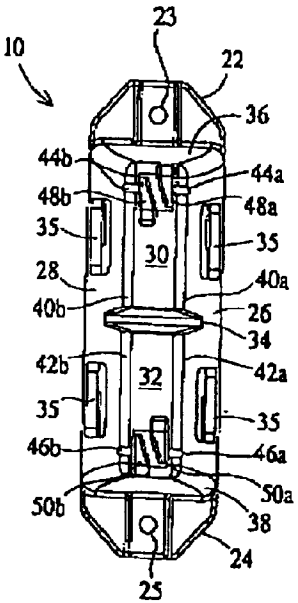
Figure 1C:
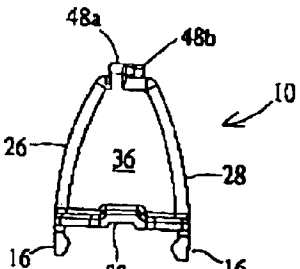
Figure 1A:
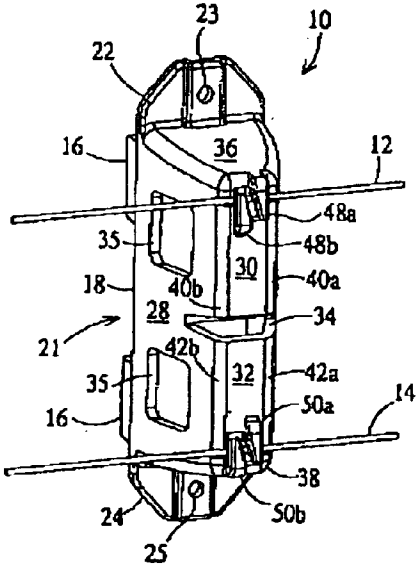
FIG. 1A is a perspective view of an insulator in accordance with a preferred embodiment of the invention.

With reference to FIGS. 1A–1D, there is shown a fence insulator 10 in accordance with a preferred embodiment of the invention. The insulator 10 is shown in FIG. 1A having a ground wire 12 and current carrying wire 14 installed thereon adjacent a mounting face thereof to maintain the wires 12 and 14 in a desired spaced apart relationship. Heretofore, separate insulators have been used with electric fences of the type having a ground wire and a current carrying wire. That is, on a post, a first insulator is used to support the current carrying wire, while a second insulator is used to support the ground wire. The present invention now enables the use of a single or unitary insulator on a post or support to support both the current carrying wire and the ground wire to maintain them separate and in electrical isolation from one another.

The insulator 10 is preferably of one-piece molded plastic construction and configured to be mounted to a vertically oriented metal or wood post. For example, the insulator 10 includes arms 16 which extend from rear edges 18 and 20 of a main body 21 of the insulator 10. The arms 16 are spaced and configured to snap fit around a metal post of the type commonly used for fencing.

The insulator 10 also preferably includes an upper mounting member 22 having an aperture 23 and a lower mounting member 24 having aperture 25. Fasteners, such as screws or the like may be passed through the apertures 23 and 25 for mounting the insulator 10 to a support such as a wood post. The mounting members 22 and 24 are preferably substantially planar extensions from the main body 21 of the insulator 10.

The body 21 has a hollow interior defined within a pair of spaced apart sidewalls 26 and 28 connected by a connecting wall or wire mounting face having first and second portions shown as walls 30 and 32 separated by a discontinuity such as gap 34 corresponding to cutaway portions of the sidewalls 26 and 28. The gap 34 is aesthetically pleasing and advantageously reduces the likelihood of electrical communication, e.g., the formation of a carbon arc trail or the like, between the wires. Similarly, cutouts or windows 35 are preferably provided on the sidewalls 26 and 28 to reduce the likelihood of electrical communication and to reduce weight and material costs.

An end wall 36 is located at one end of the body 21 adjacent to and generally perpendicular to the sidewalls 26, 28 and the connecting wall 30. An end wall 38 is likewise located at the opposite end of the body 21.

The junctures between the sidewalls 26, 28 and the connecting walls 30 and 32 are preferably beveled or rounded to define edges 40*a* and 40*b* adjacent the connecting wall 30, and edges 42*a* and 42*b* adjacent the connecting wall 32. Aligned grooves 44*a* and 44*b* are defined across the edges 40*a* and 40*b* for receiving the wire 12. Likewise, aligned grooves 46*a* and 46*b* are defined across the edges 42*a* and 42*b* for receiving the wire 14. The grooves 44*a*–46*b* are preferably closely adjacent the end walls 36 and 38, respectively.

A pair of oppositely disposed fingers 48*a* and 48*b* are defined adjacent the connecting wall 30 to retain the wire 12 within the grooves 44*a* and 44*b*. The finger 48*a* is preferably spaced slightly interior the groove 44*a* and extends from adjacent the end wall 36 to a location past, e.g., below the groove 44*a* in the context of the depicted orientation. The finger 48*b* is preferably spaced slightly interior the groove 44*b* and extends from a location below the groove 44*b* to a point just above the groove 44*b*. Likewise, a pair of oppositely disposed fingers 50*a* and 50*b* are defined adjacent the connecting wall 32 and similarly positioned to retain the wire 14 within the grooves 46*a* and 46*b*.

To provide an electric fence, each insulator 10 is installed on a support, such as a post, by use of the arms 16 or the mounting members 22 and 24 in conjunction with fasteners. The insulators are preferably generally aligned in a common horizontal plane. The wires 12 and 14 are installed on the insulators as in the manner shown in FIG. 1A, by manipulating the wire 12 through the gap between the fingers 48*a*, 48*b*, and the wire 14 through the gap between the fingers 50*a*, 50*b*.

After the wires are installed on all of the insulators, the wires are tightened to a desired tension, with the wire 12 seated within the grooves 44*a*, 44*b* of the insulators 10, and the wire 14 seated within the grooves 46*a*, 46*b* of the insulators 10. The fingers 48*a*, 48*b*, cooperate to retain the wire 12 within the grooves 44*a*, 44*b*, and the fingers 50*a*, 50*b* cooperate to retain the wire 14 within the grooves 46*a*, 46*b*.

FIGS. 2A–2D

Figure 2D:
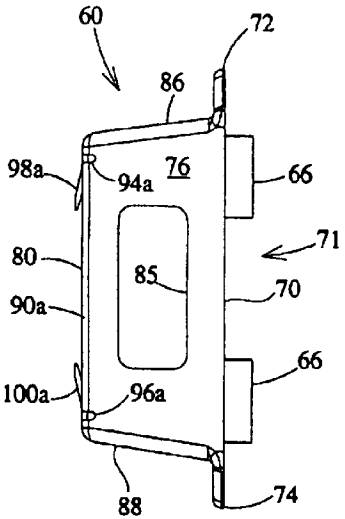
FIGS. 2B–2D are front, top, and left side plan views, respectively, of the insulator of FIG. 2A.
Figure 2B:
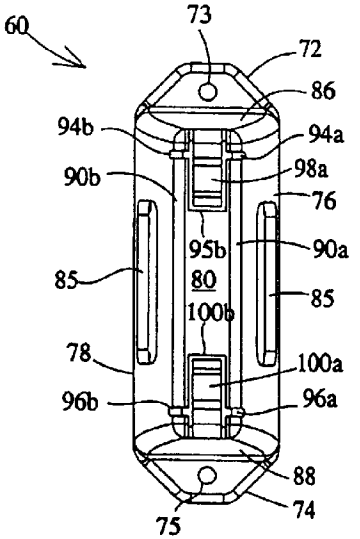
Figure 2C:
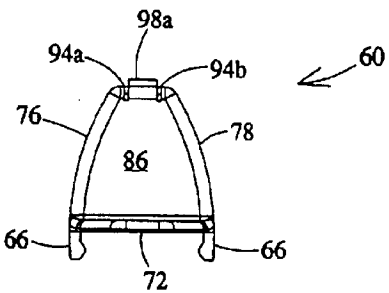
Figure 2A:
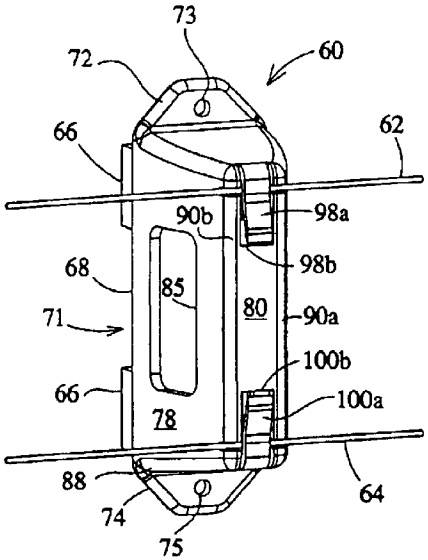
FIG. 2A is a perspective view of an insulator in accordance with another embodiment of the invention.

With reference now to FIGS. 2A–2D, there is shown another embodiment of an insulator 60. The insulator 60 is shown in FIG. 2A having a ground wire 62 and current carrying wire 64 installed thereon to maintain the wires 62 and 64 in a desired spaced apart relationship.

The insulator 60 is preferably of one-piece molded plastic construction and configured to be mounted to a vertically oriented metal or wood post. The insulator 60 includes arms 66 which extend from rear edges 68 and 70 of a main body 71 of the insulator 60. The arms 66 are spaced and configured to snap fit around a metal fence post.

The insulator 60 also preferably includes an upper mounting member 72 having an aperture 73 and a lower mounting member 74 having aperture 75. Fasteners, such as screws or the like may be passed through the apertures 73 and 75 for mounting the insulator 60 to a support such as a wood post. The mounting members 72 and 74 are preferably substantially planar extensions from the main body 71 of the insulator 60.

The body 71 has a hollow interior defined within a pair of spaced apart sidewalls 76 and 78 connected by a connecting wall 80. Windows 85 are provided on the sidewalls 76 and 78 to reduce weight and material costs. An end wall 86 is located at one end of the body 71 adjacent to and generally perpendicular to the sidewalls 76, 78 and one end of the connecting wall 80. An end wall 88 is likewise located at the opposite end of the body 71.

The junctures between the sidewalls 76, 78 and the connecting wall 80 are preferably rounded to define edges 90*a* and 90*b* adjacent the connecting wall 80. Aligned grooves 94*a* and 94*b* are defined across the edges 90*a* and 90*b* at one end of connecting wall 80 for receiving the wire 62. Aligned grooves 96*a* and 96*b* are defined across the edges 90*a* and 90*b* at the opposite end of the connecting wall 80 for receiving the wire 64. The grooves 94*a*–96*b* are preferably closely adjacent to end walls 86 and 88, respectively.

A flexible tab 98*a* is defined adjacent the connecting wall 80 and a corresponding and underlying cutout 98*b* is defined within the connecting wall 80 to retain the wire 62 within the grooves 94*a* and 94*b*. Likewise, a tab 100*a* and cutout 100*b* are similarly defined and positioned to retain the wire 64 within the grooves 96*a* and 96*b*. The tabs 98*a* and 100*a* preferably both open toward the middle of the connecting wall 80.

To provide an electric fence, each insulator 60 is installed on a support, such as a post, by use of the arms 66 or the mounting members 72 and 74 in conjunction with fasteners. The insulators are preferably generally aligned in a common horizontal plane. The wires 62 and 64 are installed on the insulators as in the manner shown in FIG. 2A, by flexing the tab 98*a* in a direction away from the connecting wall 80 and passing the wire 62 underneath the tab 98*a* to locate it across the cutout 98*b*. Similarly, the tab 100*a* is flexed and the wire 64 passed underneath to locate it across the cutout 100*b*.

After the wires are installed on all of the insulators, the wires are tightened to a desired tension, with the wire 62 seated within the grooves 94*a,* 94*b* of the insulators 60, and the wire 64 seated within the grooves 96*a,* 96*b* of the insulators 60. The tab 98*a* and cutout 98*b* cooperate to retain the wire 62 within the grooves 94*a,* 94*b,* and the tab 100*a* and cutout 100*b* cooperate to retain the wire 64 within the grooves 96*a,* 96*b.*

FIGS. 3A–3D

Figure 3A:
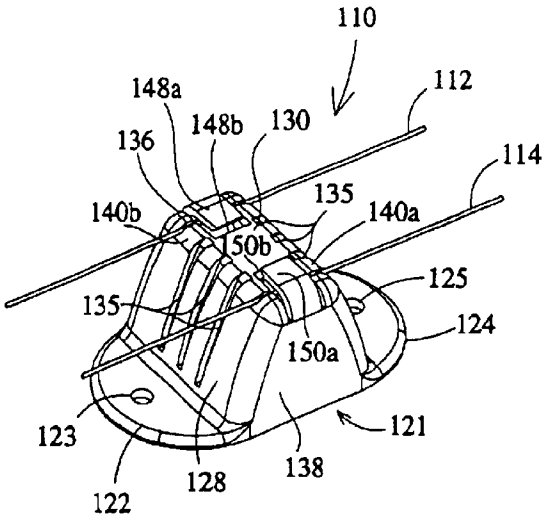
FIG. 3A is a perspective view of an insulator in accordance with yet another embodiment of the invention.
Figure 3B:
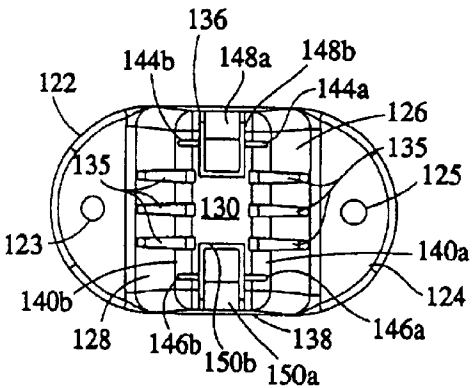
FIGS. 3B–3D are top, end, and side plan views, respectively, of the insulator of FIG. 3A.
Figure 3C:
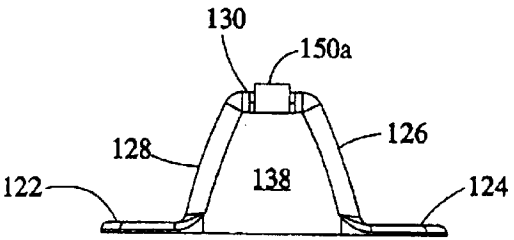
Figure 3D:
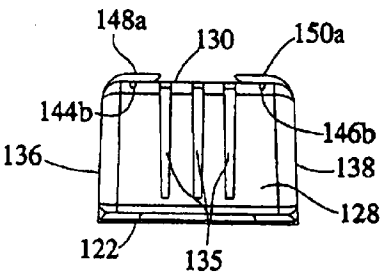

Turning now to FIGS. 3A–3D, there is shown yet another embodiment of an insulator 10. The insulator 110 is shown in FIG. 3A having a ground wire 112 and current carrying wire 114 installed thereon to maintain the wires 112 and 114 in a desired spaced apart relationship.

The previous embodiments of insulators 10 and 60 are preferably utilized for mounting of wires on posts and other generally vertical supports. The insulator 110 is particularly configured and preferably utilized for mounting of wires on boards and other generally horizontal supports. This insulator 110 is thus particularly suitable for providing electric fences for use in thwarting birds from perching on balconies and the like.

The insulator 110 preferably includes a main body 121, with a first mounting member 122 having an aperture 123 and a second mounting member 124 having aperture 125. Fasteners, such as screws or the like may be passed through the apertures 123 and 125 for mounting the insulator 110 to a support such as a board. The mounting members 122 and 124 are preferably substantially planar extensions from the main body 121 of the insulator 110.

The body 121 has a hollow interior defined within a pair of spaced apart sidewalls 126 and 128 connected by a connecting wall 130. Grooves 135 are provided on the sidewalls 126 and 128 to reduce the likelihood of electrical communication between the wires. An end wall 136 is located at one end of the body 121 adjacent to and generally perpendicular to the sidewalls 126, 128 and one end of the connecting wall 130. An end wall 138 is likewise located at the opposite end of the body 121.

The junctures between the sidewalls 126, 128 and the connecting wall 130 are preferably rounded to define edges 140*a* and 140*b* adjacent the connection wall 130. Aligned grooves 144*a* and 144*b* are defined across the edges 140*a* and 140*b* at one end of connecting wall 130 for receiving the wire 112. Aligned grooves 146*a* and 146*b* are defined across the edges 140*a* and 140*b* at the opposite end of the connecting wall 130 for receiving the wire 114. The grooves 144*a*–146*b* are preferably closely adjacent the end walls 136 and 138, respectively.

A flexible tab 148*a* is defined adjacent the connecting wall 130 and a corresponding and underlying cutout 148*b* is defined within the connecting wall 130 to retain the wire 112 within the grooves 144*a* and 144*b*. Likewise, a tab 150*a* and cutout 150*b* are similarly defined and positioned to retain the wire 114 within the grooves 146*a* and 146*b*. The tabs 148*a* and 150*a* preferably both open toward the middle of the connecting wall 130.

To provide an electric fence, each insulator 110 is installed on a support, such as a board, window ledge, rooftop, and the like, by use of the mounting members 122 and 124 in conjunction with fasteners. The insulators are preferably generally aligned in a common plane, such as along the railing of a balcony. The wires 112 and 114 are installed on the insulators as in the manner shown in FIG. 3A, by flexing the tab 148*a* in a direction away from the connecting wall 130 and passing the wire 112 underneath the tab 148*a* to locate it across the cutout 148*b*. Similarly, the tab 150*a* is flexed and the wire 114 passed underneath to locate it across the cutout 150*b*.

After the wires are installed on all of the insulators, the wires are tightened to a desired tension, with the wire 112 seated within the grooves 144*a,* 144*b* of the insulators 110, and the wire 114 seated within the grooves 146*a,* 146*b* of the insulators 110. The tab 148*a* and cutout 148*b* cooperate to retain the wire 112 within the grooves 114*a,* 114*b,* and the tab 150*a* and cutout 150*b* cooperate to retain the wire 114 within the grooves 146*a,* 146*b.*

FIGS. 4A–4D

With reference now to FIGS. 4A–4D, there is shown another embodiment of an insulator 160 that is particularly configured and preferably utilized for mounting of wires and boards and other generally horizontal supports. The insulator 160 is particularly configured for installations at corners of the fence or other locations where the direction of the wire is to undergo a relatively abrupt change of direction.

Figure 4A:
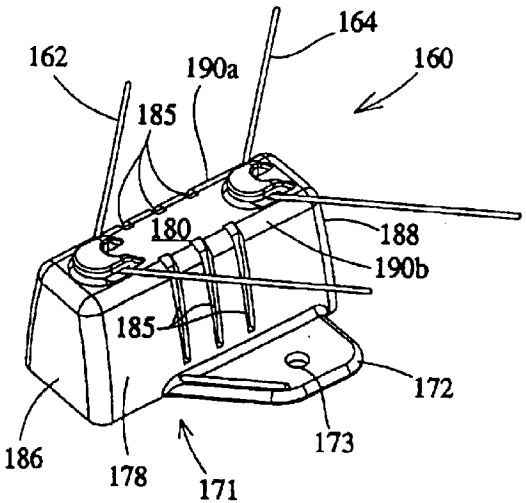
FIG. 4A is a perspective view of an insulator in accordance with still another embodiment of the invention.
Figure 4B:
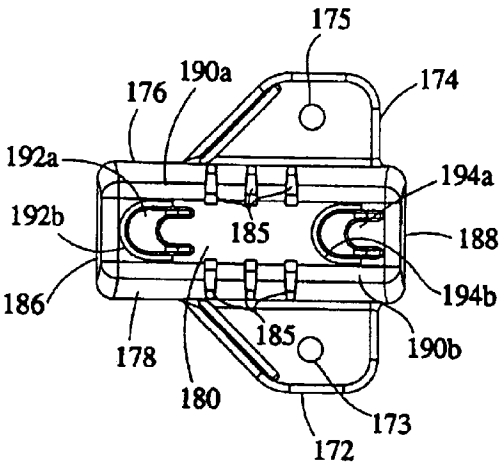
FIGS. 4B–4D are top, side, and end plan views, respectively, of the insulator of FIG. 4A.
Figure 4C:
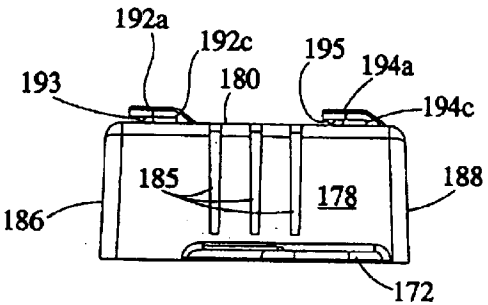
Figure 4D:
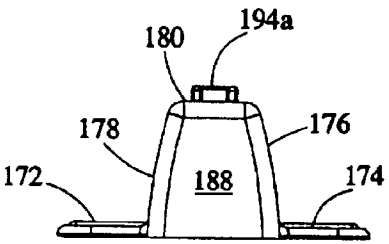

In this regard, insulator 160 is shown in FIG. 4A having a ground wire 162 and current carrying wire 164 installed thereon to maintain the wires 162 and 164 in a desired spaced apart relationship as the directions of the wires undergoes a relatively abrupt change. Insulators, such as the previously described insulators 110, are preferably used to support the wires at locations spaced apart from and on either side of the insulator 160.

The insulator 160 preferably includes a main body 171, with a first mounting member 172 having an aperture 173 and a second mounting member 174 having aperture 175. Fasteners, such as screws or the like may be passed through the apertures 173 and 175 for mounting the insulator 160 to a support such as a board. The mounting members 172 and 174 are preferably substantially planar extension from the main body 171 of the insulator 160.

The body 171 has a hollow interior defined within a pair of spaced apart sidewalls 176 and 178 connected by a connecting wall 180. Cutouts 185 are provided on the sidewalls 176 and 178 to reduce the likelihood of electrical communication between the wires. An end wall 186 is located at one end of the body 171 adjacent to and generally perpendicular to the sidewalls 176, 178 and one end of the connecting wall 180. An end wall 188 is likewise located at the opposite end of the body 171.

The junctures between the sidewalls 176, 178 and the connecting wall 180 are preferably rounded to define edges 190*a* and 190*b* adjacent the connecting wall 180. A rigid tab 192*a* is defined adjacent the connecting wall 180 and the end 186 and a corresponding and underlying cutout 192*b* is defined within the connecting wall 180. The tab 192*a* includes a projection 193 on a surface thereof facing the cutout 192*b*. Likewise, a rigid tab 194*a* having a projection 195, and cutout 194*b* are similarly defined adjacent the opposite end 188. Both of the tabs 192*a* and 194*a* preferably open toward a common end, such as the end 186, so that the wires 162 and 164 bear against closed ends 192*c* and 194*c* of the rigid tabs 192*a* and 194*a*. The closed ends 192*c* and 194*c* are preferably curved to provide a radius for the wires to curve around to reduce stresses on the wires as they undergo a relatively abrupt change of direction. The cutouts are preferred to facilitate passage of the wires underneath the projections 193, 195 when installing the wires 162, 164 on the insulator 160.

To provide an electric fence, each insulator 160 is installed on a support, such as a board, by use of the mounting members 172 and 174 in conjunction with fasteners. As noted above, the insulator 160 is particularly configured for installations at corners of the fence or other locations where the direction of the wire is to undergo a relatively abrupt change of direction, and is particularly configured for use in conjunction with the insulators 110 described previously in connection with FIGS. 3A–3D. The wires 162 and 164 are installed on the insulator 160 as in the manner shown in FIG. 4A, by urging them past the projections 193 and 195 so that the wires are positioned underneath the tabs and trapped between the projections and the closed ends of the tabs. The projections help to maintain the wires underneath the tabs until the wires are tightened. The wires are then tensioned, with the tension serving to retain the wires underneath the tabs.

The foregoing description of certain exemplary embodiments of the present invention has been provided for purposes of illustration only, and it is understood that numerous modifications or alterations may be made in and to the illustrated embodiments without departing from the spirit and scope of the invention as defined in the following claims.

What is claimed is:

1. A fence insulator for maintaining a pair of fence wires in a desired common plane and spaced a desired distance apart, the insulator comprising a body of molded plastic construction mountable to a support and including a pair of spaced apart sidewalls connected by a connecting wall; a first pair of aligned grooves defined across a first portion of the connecting wall; a first retention member positioned adjacent the first pair of aligned grooves and configured for receiving one of the wires underneath a portion thereof; a second pair of aligned grooves defined across a second portion of the connecting wall spaced apart from and substantially parallel to the first pair of aligned grooves; and a second retention member positioned adjacent the second pair of aligned grooves and configured for receiving one of the wires underneath a portion thereof, wherein one of the wires is positionable underneath the first retention member and within the first pair of aligned grooves and the other one of the wires is positionable underneath the second retention member and within the second pair of aligned grooves.

2. The fence insulator claim 1, wherein the first retention member comprises a pair of oppositely disposed fingers located adjacent the first portion of the connecting wall and spaced interior the first pair of grooves, and the second retention member comprises a pair of oppositely disposed fingers located adjacent the second portion of the connecting wall and spaced interior the second pair of grooves.

3. The fence insulator of claim 1, wherein the first retention member comprises a first flexible tab defined adjacent the first portion of the connecting wall with an underlying cutout defined within the first portion of the connecting wall, and the second retention member comprises a second flexible tab defined adjacent the second portion of the connecting wall with an underlying cutout defined within the second portion of the connecting wall, wherein the first and second flexible tabs open in opposite directions toward a middle portion of the connecting wall.

4. The fence insulator of claim 1, further comprising arms extending from edges of the body, the arms spaced apart and configured to snap fit around a post.

5. The fence insulator of claim 1, further comprising mounting members comprising substantially planar portions extending from opposite locations of the body in substantially opposite directions for mounting the insulator to a support surface.

6. The fence insulator of claim 1, wherein the mounting members extend from opposite sides of the body.

7. The fence insulator of claim 5, wherein the mounting members extend from opposite ends of the body.

8. The fence insulator of claim 1, further comprising one or more discontinuities defined on the body for reducing the likelihood of electrical communication between the wires when they are installed on the insulator.

9. A fence insulator for maintaining a pair of fence wires in a desired common plane and spaced a desired distance apart, the insulator comprising an elongate body of molded plastic construction mountable to support and including a wire mounting face; a first retention member position adjacent the wire mounting face and configured for receiving one of the wires underneath a portion thereof; and a second retention member configured for receiving the other one of the wires underneath a portion thereof and located adjacent the wire mounting face and longitudinally spaced apart from the first retention member.

10. The fence insulator of claim 9, wherein the first retention member comprises a first rigid tab with an underlying first cutout defined within a first portion of the wire mounting face, and the second retention member comprises a second rigid tab with an underlying second cutout defined within a second portion of the wire mounting face, wherein the first and second rigid tabs open in the same direction toward an end of the insulator.

11. The insulator of claim 10, wherein the first rigid tub includes a projection on a surface thereof facing the first cutout, and the second rigid tab includes a projection on a surface thereof facing the second cutout.

12. The fence insulator of claim 9, wherein the first retention member comprises a pair of oppositely disposed fingers, and the second retention member comprises a pair of oppositely disposed fingers.

13. The fence insulator of claim 9, wherein the first retention member comprises a first flexible tab, and the second retention member comprises a second flexible tab, wherein the first and second flexible tabs open in opposite directions toward a middle portion of the mounting face.

14. The fence insulator of claim 9, further comprising arms extending from edges of the body, the arms spaced apart and configured to snap fit around a post.

15. The fence insulator of claim 9, further comprising mounting members comprising plurality planar portions extending from opposite locations of the body in substantially opposite directions for mounting the insulator to a support surface.

16. The fence insulator of claim 15, wherein the mounting members extend from opposite sides of the body.

17. The fence insulator of claim 15, wherein the mounting members extend from opposite ends of the body.

18. The fence insulator of claim 9, further comprising one or more discontinuities defined on the body for reducing the likelihood of electrical communication between the wires when they are installed on the insulator.

19. A fence insulator for installation at corners of a fence where first and second spaced apart fence wires undergo an abrupt change of direction, the insulator comprising an elongate body of molded plastic construction mountable to a support and including a wire mounting face; a first rigid tab positioned adjacent the wire mounting face and having an opening for passage of the first wire and a curved closed end configured for bearing against the first wire to provide a radius for the first wire to curve around to reduce stresses on the first wire as it undergoes a relatively abrupt change of direction; and a second rigid tab positioned adjacent the wire mounting face longitudinally spaced apart from the first tab and having an opening for passage of the second wire and a curved closed end configured for bearing against the second wire to provide a radius for the second wire to curve around to reduce stresses on the second wire as it undergoes a relatively abrupt change of direction.

20. The fence insulator of claim 19, wherein the first rigid tab includes a projection on a surface thereof facing the wire mounting surface, and the second rigid tab includes a projection on a surface thereof facing the wire mounting surface.

21. The fence insulator of claim 19, further comprising one or more discontinuities defined on the body for reducing the likelihood of electrical communication between the wires when they are installed on the insulator.

22. A fence system, comprising a current carrying wire connectable to a source of electric current, a ground wire, and a unitary insulator configured to receive the current carrying wire and the ground wire and to maintain the wires in a spaced apart and electrically isolated orientation.

23. The fence system of claim 22, wherein the insulator comprises a body of molded plastic construction mountable to a support and including a pair of spaced apart sidewalls connected by a connecting wall; a first pair of aligned grooves defined across a first portion of the connecting wall; a first retention member positioned adjacent the first pair of aligned grooves and configured for receiving one of the wires underneath a portion thereof; a second pair of aligned grooves defined across a second portion of the connecting wall spaced apart from and substantially parallel to the first pair of aligned grooves; and a second retention member positioned adjacent the second pair of aligned grooves and configured for receiving one of the wires underneath a portion thereof, wherein one of the wires is positionable underneath the first retention member and within the first pair of aligned grooves and the other one of the wires is positionable underneath the second retention member and within the second pair of aligned grooves.

24. The fence system of claim 23, wherein the insulator comprises an elongate body of molded plastic construction mountable to a support and including a wire mounting face; a first retention member positioned adjacent the wire mounting face and configured for receiving one of the wires underneath a portion thereof; and a second retention member configured for receiving the other one of the wires underneath a portion thereof and located adjacent the wire mounting face and longitudinally spaced apart from the first retention member.

25. The fence system of claim 23, wherein the insulator comprises an elongate body of molded plastic construction mountable to a support and including a wire mounting face; a first rigid tab positioned adjacent the wire mounting face and having an opening for passage of the current carrying wire and a curved closed end configured for bearing against the current carrying wire to provide a radius for the current carrying wire to curve around to reduce stresses on the current carrying wire as it undergoes a relatively abrupt change of direction; and a second rigid tab positioned adjacent the wire mounting face longitudinally spaced apart from the first tab and having an opening for passage of the ground wire and a curved closed end configured for bearing against the ground wire to provide a radius for the ground wire to curve around to reduce stresses on the ground wire as it undergoes a relatively abrupt change of direction.

* * * * *